US008517171B1

(12) United States Patent
Delgado

(10) Patent No.: US 8,517,171 B1
(45) Date of Patent: Aug. 27, 2013

(54) HOLDING DEVICE FOR ANTIBACTERIAL WIPES AND GEL

(76) Inventor: Richard Delgado, East Meadow, NY (US)

( * ) Notice: Subject to any disclaimer, the term of this patent is extended or adjusted under 35 U.S.C. 154(b) by 103 days.

(21) Appl. No.: 13/240,155

(22) Filed: Sep. 22, 2011

(51) Int. Cl.
*B65D 69/00* (2006.01)

(52) U.S. Cl.
USPC ..... 206/38.1; 206/233; 206/37; 206/229

(58) Field of Classification Search
USPC ..... 206/37, 38, 37.1, 233, 5, 581, 229; 132/286, 315; 401/123, 124, 125; 15/214, 15/104.93
See application file for complete search history.

(56) References Cited

U.S. PATENT DOCUMENTS

| | | | | |
|---|---|---|---|---|
| 1,615,319 | A * | 1/1927 | Wynn | 206/229 |
| 2,377,117 | A * | 5/1945 | Watkins | 206/225 |
| 3,647,059 | A * | 3/1972 | Humphreys | 242/564 |
| 4,854,449 | A * | 8/1989 | Fitzhugh | 206/37 |
| 5,439,104 | A * | 8/1995 | Wolska-Klis | 206/233 |
| 5,927,548 | A | 7/1999 | Villaveces | |
| D433,562 | S | 11/2000 | Redlinger | |
| 6,164,442 | A * | 12/2000 | Stravitz | 206/233 |
| 6,170,651 | B1 * | 1/2001 | Taormina | 206/5 |
| 6,234,357 | B1 | 5/2001 | Lewis | |
| 6,394,987 | B1 | 5/2002 | Sandlin et al. | |
| 7,004,354 | B2 | 2/2006 | Harper | |
| 7,201,271 | B1 * | 4/2007 | Saad | 206/63.5 |
| 7,285,114 | B2 | 10/2007 | Harper | |
| 7,370,754 | B2 * | 5/2008 | Kushner | 206/38 |
| 7,377,709 | B2 | 5/2008 | Butler | |
| D630,010 | S * | 1/2011 | Brown | D3/208 |
| 2003/0143016 | A1 * | 7/2003 | Kushner et al. | 401/125 |
| 2004/0253153 | A1 | 12/2004 | Barone | |
| 2007/0164050 | A1 | 7/2007 | Knight | |

* cited by examiner

*Primary Examiner* — David Fidei

(57) ABSTRACT

A device for holding antibacterial gel and wipes in two separate compartments that are connected, one compartment having a slot to dispense antibacterial wipes, the other compartment having an opening with a lid to dispense an antibacterial liquid or gel. The device also has an attachment mechanism which can be attached to items such as a key ring for easy access while on the go.

20 Claims, 3 Drawing Sheets

TOP VIEW

FRONT VIEW

HOLDING DEVICE FOR ANTIBACTERIAL WIPES AND GEL

FIELD OF THE INVENTION

The present invention is directed to a holding device for holding both antibacterial wipes and antibacterial gels.

BACKGROUND OF THE INVENTION

The present invention is directed to a holding device for antibacterial wipes and gel. The holding device of the present invention provides an easy access to hand wipes and sanitizer gel while a user is on the go to help maintain good hygiene and to prevent the spread of germs.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
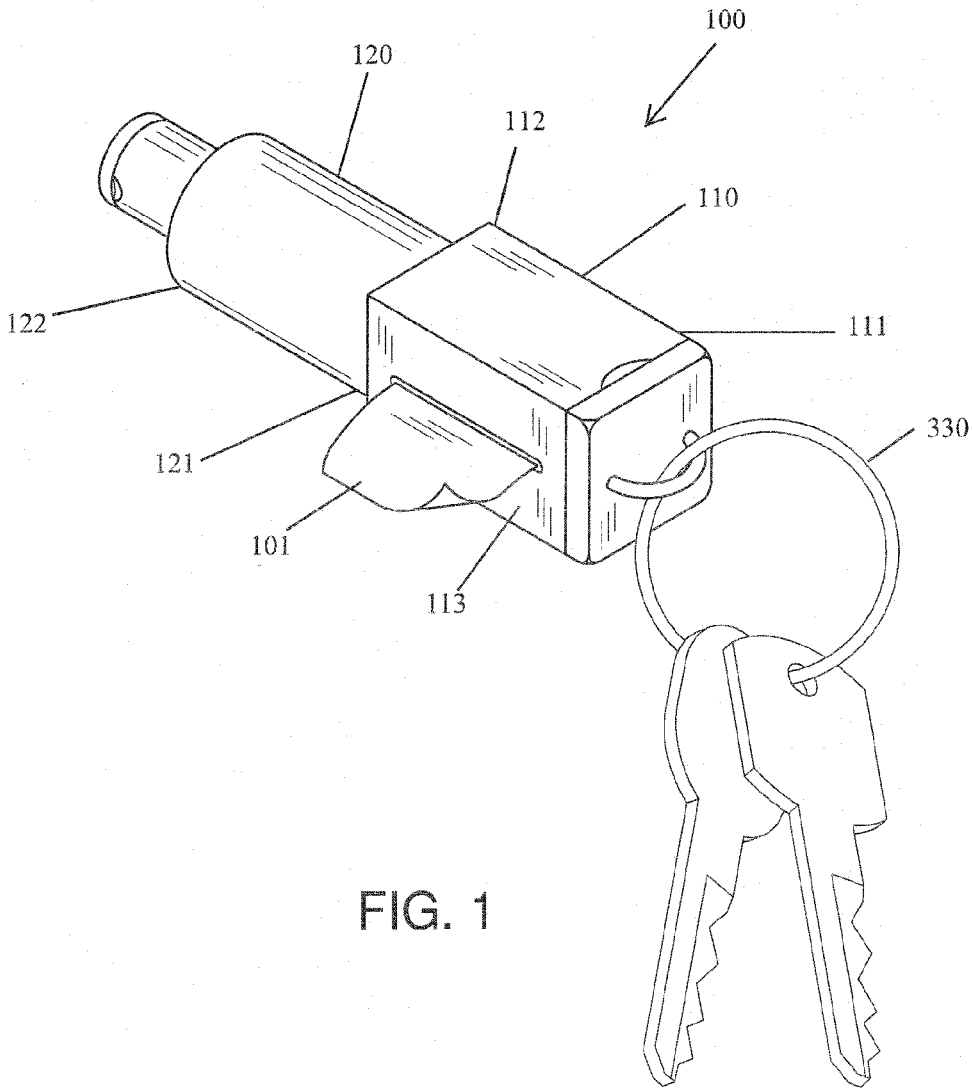
FIG. 1 is a perspective view of a holding device for antibacterial wipes and gel.
Figure 2:
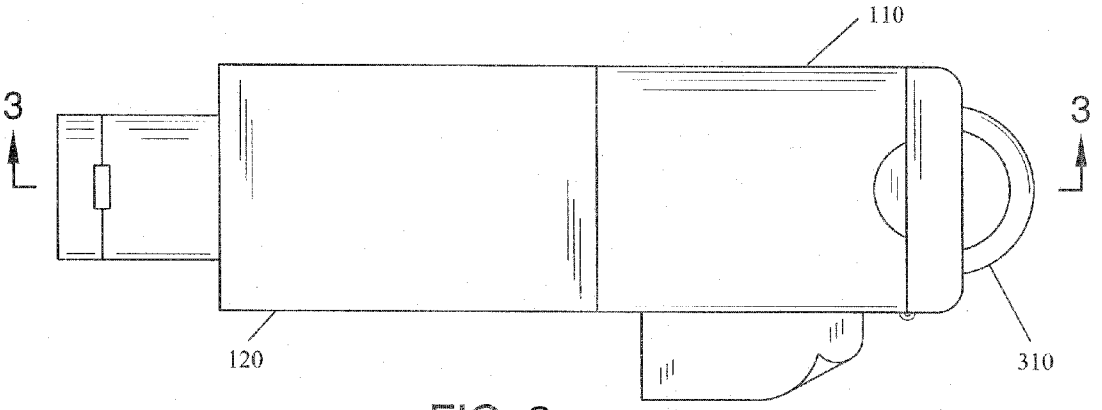
FIG. 2 is a top view of a holding device for antibacterial wipes and gel.
Figure 3:
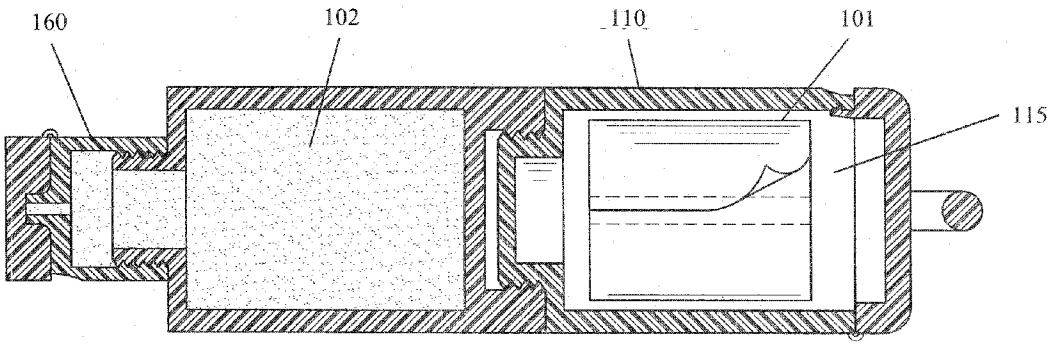
FIG. 3 is a cross-sectional top view of a holding device for antibacterial wipes and gel.
Figure 4:
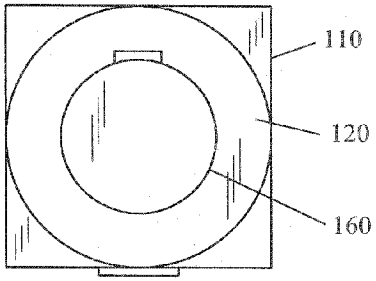
FIG. 4 is a front view of a holding device for antibacterial wipes and gel.
Figure 5:
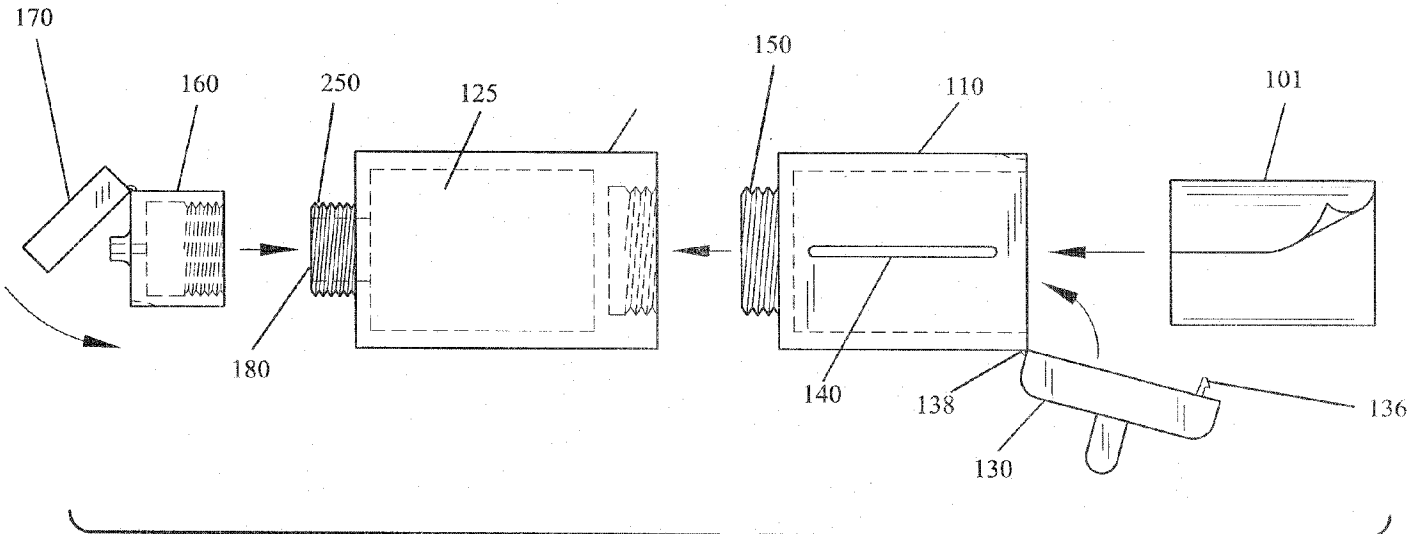
FIG. 5 is a separated side view of a holding device for antibacterial wipes and gel.

Referring now to FIG. 1-5, the present invention features a device 100 that holds both antibacterial wipes and antibacterial gels. The device 100 comprises a first compartment 110 having a first end 111, a second end (12, a side wall 113, and an inner cavity 115. The inner cavity 115 of the first compartment 110 is adapted to hold a wipe 101. Having wipes on hand can help to remove germs from items in public places such as door knobs and handles that are touched by many people frequently. It also helps to remove dirt and germs off of hands rather than with sanitizer gel which may just push dirt around.

The device 100 further comprises a door 130 disposed in the first compartment 110 which can move between at least an open position and a closed position respectively allowing and preventing access to the inner cavity 115 of the first compartment 110. In some embodiments, the door 130 could be in the side wall 113 of the first compartment 110 and is not limited to being on the first end 111.

The device 100 further comprises a slot 140 disposed in the side wall 113 of the first compartment 110 which allows a wipe 101 in the inner cavity 115 of the first compartment to be removed. In some embodiments, the slot 140 could be in the first end 111 of the first compartment 110 and is not limited to being in the side wall 113.

The device 100 further comprises a second compartment 120 having a first end 121, a second end 122, and an inner cavity 125. The first end 121 of the second compartment 120 is connected to the second end (12 of the first compartment 110. The inner cavity 125 of the second compartment 120 is adapted to hold a liquid 102 (e.g., antibacterial gel or other liquid).

The device 100 further comprises a hole 180 disposed in the second compartment 120 for allowing removal of liquid 102 from the inner cavity 125 of the second compartment. The device 100 further comprises a cap 160 temporarily covering the hole 180 in the second compartment 120. The cap 160 allows or prevents removal of liquid 102 from the inner cavity 125 of the second compartment. The screw-on cap or pop-off cap is well known to one of ordinary skill in the art.

In some embodiments, the first compartment 110 is generally cuboidal in shape. In some embodiments the wipe 101 is a roll of wipes. In some embodiments the, wipe 101 is an antibacterial wipe. In some embodiments the door 130 is disposed in the first end 111 of the first compartment 110. In some embodiments the door 130 is attached to the first compartment 110 via a hinge component 138. In some embodiments the door 130 can be secured in the closed position via a securing mechanism 136. In some embodiments the slot 140 comprises a cutting means adapted to cut the wipe 101 as it is removed from the inner cavity 115 of the first compartment 110.

In some embodiments the second compartment 120 is generally cylindrical in shape. In some embodiments the liquid 102 is an antibacterial liquid or an antibacterial gel.

In some embodiments the second compartment 120 is removably connected to the first compartment 110 via a screw mechanism. In some embodiments the screw mechanism comprises a first screw component 150 disposed on the second end (12 of the first compartment 110 and a second screw component 250 disposed on the first end 121 of the second compartment 120. In some embodiments the first screw component 150 is male screw component and the second screw component 250 is a female screw component. In some embodiments the second screw component 250 is male screw component and the first screw component 150 is a female screw component. The connection for the first and second compartments is not limited to a screw mechanism, and could be a snap mechanism, a tie mechanism, a hook-and-loop fastener mechanism, a clasp mechanism, or the like.

In some embodiments the hole 180 is disposed in the second end 122 of the second compartment 120. The hole in the second compartment allows the second compartment to be filled with the liquid 102 (e.g., antibacterial liquid, antibacterial gel).

In some embodiments the cap 160 is a pop-off cap or a screw-on cap. In some embodiments the cap 160 further comprises a lid 170. In some embodiments the lid 170 is pivotally attached to the cap 160.

In some embodiments the device further comprises an accessory attachment component 310. In some embodiments the accessory attachment component 310 is disposed on the first compartment 110. In some embodiments the accessory attachment component 310 is disposed on the second compartment 120. In some embodiments the accessory attachment component 310 is adapted to accept a key ring 330.

In some embodiments the device is between about 3 to 4 inches in length as measured from the first end 111 of the first compartment to the second end 122 of the second compartment 120. In some embodiments the device 100 is between about 4 to 6 inches in length as measured from the first end 111 of the first compartment to the second end 122 of the second compartment 120.

As used herein, the term "about" refers to plus or minus 10% of the referenced number. For example, an embodiment wherein the device is about 4 inches in length includes a device that is between 3.6 and 4.4 inches in length.

The disclosures of the following U.S. Patents are incorporated in their entirety by reference herein: U.S. Pat. No. 5,927,548; U.S. Design Pat. No. D433,562; U.S. Pat. No. 6,234,357; U.S. Pat. No. 6,394,987; U.S. Pat. No. 7,004,354; U.S. Pat. No. 7,285,114; U.S. Pat. No. 7,377,709; U.S. Pat. Application No. 2004/0253153; U.S. Pat. Application No. 2007/0164050.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A device for holding antibacterial wipes or gel (100) comprising:

(a) a first compartment (110) having a first end (111), a second end (112), a side wall (113), and an inner cavity (115), the inner cavity (115) of the first compartment (110) is adapted to hold a wipe (101);

(b) a door (130) disposed in the first compartment (110), the door (130) can move between at least an open position and a closed position respectively allowing and preventing access to the inner cavity (115) of the first compartment (110);

(c) a slot (140) disposed in the side wall (113) of the first compartment (110), the slot (140) is sized to allow a wipe (101) in the inner cavity (115) of the first compartment to be removed;

(d) a second compartment (120) having a first end (121), a second end (122) and an inner cavity (125), the first end (121) of the second compartment (120) being connected to the second end (112) of the first compartment (110) the inner cavity (125) of the second compartment (120) is adapted to hold a liquid (102);

(e) a hole (180) disposed in the second compartment (120) for allowing removal of liquid (102) from the inner cavity (125) of the second compartment; and (f) a cap (160) temporarily covering the hole (180) in the second compartment (120), the cap (160) for allowing or preventing removal of liquid (102) from the inner cavity (125) of the second compartment.

2. The device of claim 1, wherein the wipe (101) is a roll of wipes.

3. The device of claim 1, wherein the wipe (101) is an antibacterial wipe.

4. The device of claim 1, wherein the door (130) is disposed in the first end (111) of the first compartment (110).

5. The device of claim 1, wherein the door (130) is attached to the first compartment (110) via, a hinge component (138).

6. The device of claim 1, wherein the door (130) can be secured in the closed position via a securing mechanism (136).

7. The device of claim 1, wherein the slot (140) comprises a cutting means adapted to cut the wipe (101) as it is removed from the inner cavity (115) of the first compartment (110).

8. The device of claim 1, wherein the liquid (102) is an antibacterial liquid or an antibacterial gel.

9. The device of claim 1, wherein the second compartment (120) is removably connected to the first compartment (110) via a screw mechanism.

10. The device of claim 9, wherein the screw mechanism comprises a first screw component (150) disposed on the second end (112) of the first compartment (110) and a second screw component (250) disposed on the first end (121) of the second compartment (120).

11. The device of claim 10, wherein the first screw component (150) is male screw component and the second screw component (250) is a female screw component.

12. The device of claim 10, wherein the second screw component (250) is male screw component and the first screw component (150) is a female screw component.

13. The device of claim 1, wherein the hole 180) is disposed in the second end 122 of the second compartment (120).

14. The device of claim 1, wherein the cap 11601 is a pop-off cap or a screw-on cap.

15. The device of claim 1, wherein the cap (160) further comprises a lid (170).

16. The device of claim 15, wherein the lid (170) is pivotally attached to the cap (160).

17. The device of claim 1 further comprising an accessory attachment component (310).

18. The device of claim 17, wherein the accessory attachment component (310) is disposed on the first compartment (110).

19. The device of claim 17, wherein the accessory attachment component (310) is disposed on the second compartment (120).

20. The device of claim 17, wherein the accessory attachment component (310) is adapted to accept a key ring (330).

* * * * *